US012241340B1

(12) United States Patent
Zeng et al.

(10) Patent No.: US 12,241,340 B1
(45) Date of Patent: Mar. 4, 2025

(54) COAL AND COALBED METHANE MINING SYSTEM BASED ON GROUND DRILLING, METHOD AND RELATED DEVICE

(71) Applicant: CHINA UNIVERSITY OF MINING AND TECHNOLOGY, BEIJING, Beijing (CN)

(72) Inventors: Yifan Zeng, Beijing (CN); Donghui Yang, Beijing (CN); Qiang Wu, Beijing (CN); Junhao Ren, Beijing (CN); Zilong Yuan, Beijing (CN); Fulong Zhai, Beijing (CN); Jia Zhao, Beijing (CN); Hao Li, Beijing (CN)

(73) Assignee: CHINA UNIVERSITY OF MINING AND TECHNOLOGY, BEIJING, Beijing (CN)

( * ) Notice: Subject to any disclaimer, the term of this patent is extended or adjusted under 35 U.S.C. 154(b) by 0 days.

(21) Appl. No.: 18/915,252

(22) Filed: Oct. 14, 2024

(30) Foreign Application Priority Data

Jan. 12, 2024 (CN) ..... 202410051937.5

(51) Int. Cl.

| | |
|---|---|
| ***E21B 43/00*** | (2006.01) |
| ***E21B 7/04*** | (2006.01) |
| ***E21B 7/18*** | (2006.01) |
| ***E21B 43/29*** | (2006.01) |
| ***E21B 43/34*** | (2006.01) |

(52) U.S. Cl.
CPC ..... *E21B 43/006* (2013.01); *E21B 7/18* (2013.01); *E21B 43/29* (2013.01); *E21B 43/34* (2013.01); *E21B 7/04* (2013.01)

(58) Field of Classification Search
CPC ..... E21B 43/006; E21B 7/18; E21B 43/29; E21B 43/34; E21B 7/04
See application file for complete search history.

(56) References Cited

U.S. PATENT DOCUMENTS

2016/0258265 A1 9/2016 Chen et al.
2023/0235648 A1* 7/2023 Wingo ..... E21B 33/14 166/292

FOREIGN PATENT DOCUMENTS

CN 102493794 A 6/2012
CN 113338801 A 9/2021
CN 113464136 A 10/2021

OTHER PUBLICATIONS

First Office Action issued in counterpart Chinese Patent Application No. 202410051937.5, dated May 27, 2024.

* cited by examiner

*Primary Examiner* — Janine M Kreck
(74) *Attorney, Agent, or Firm* — Westbridge IP LLC

(57) ABSTRACT

A coal and coalbed methane mining system based on ground drilling includes: a drilling component, a coal mining drill bit and a ground facility group. The coal mining drill bit is set at a predetermined end of a directional borehole in a coal seam, connected to the drilling component through a connecting pipeline. The ground facility group is connected to the drilling component, to provide coal cutting slurry for the coal mining drill bit, receive reflux slurry carrying coal and coalbed methane, and precipitate and separate the reflux slurry carrying the coal and the coalbed methane. A coal and coalbed methane mining method based on ground drilling and related devices are also disclosed.

7 Claims, 4 Drawing Sheets

COAL AND COALBED METHANE MINING SYSTEM BASED ON GROUND DRILLING, METHOD AND RELATED DEVICE

CROSS-REFERENCE TO RELATED APPLICATIONS

This application claims priority to Chinese Patent Application No. 202410051937.5, filed on Jan. 12, 2024, the content of which is incorporated herein by reference in its entirety.

TECHNICAL FIELD

The present disclosure relates to the drilling engineering technology, and in particular to a coal and coalbed methane mining system based on ground drilling, a coal and coalbed methane mining method based on ground drilling, and related devices.

BACKGROUND

As a non-renewable energy source, shallow coal resources with good occurrence conditions are going to be depleted due to increasing mining intensity and demand. The coal industry has gradually shifted towards deep coal resource extractions. However, deep mining is difficult and costly. It not only faces complex geological conditions but also unclear occurrences of resources, a high ground stress, a high temperature and a high osmotic pressure.

Furthermore, due to natural or human factors, some coal seams may have a small thickness and an excessive inclination angle, which have caused some adverse effects on mining. In related technologies, installations and managements of underground facilities are required for mining such coal seams, which poses certain risks and increases mining costs.

SUMMARY

In view of the above, examples of the present disclosure provide a coal and coalbed methane mining system based on ground drilling, a coal and coalbed methane mining method based on ground drilling and related devices to solve the above problems.

In examples of the present disclosure, the coal and coalbed methane mining system based on ground drilling may include: a drilling component; a coal mining drill bit, set at a predetermined end of a directional borehole in the coal seam, connected to the drilling component through a connecting pipeline; a ground facility group, connected to the drilling component, to provide coal cutting slurry for the coal mining drill bit, receive reflux slurry carrying coal and coalbed methane, and precipitate and separate the reflux slurry carrying the coal and the coalbed methane.

Where, the coal mining drill bit has a strip structure, with at least two pairs of nozzles installed on a side wall; the coal mining drill bit is configured to use the nozzles to spray the coal cutting slurry for mining the coal seam, and spray the coal cutting slurry to form a pressure on a coal mining site so that the reflux slurry is fed into the directional borehole and delivered to the drilling component and the ground facility group through the directional borehole.

In some examples of the present disclosure, the nozzles of the coal mining drill bit may include: at least one pair of coal cutting nozzles; where, one half of the coal cutting nozzles are direct jet nozzles and the other half of the coal cutting nozzles are rotary jet nozzles.

The at least one pair of coal cutting nozzles are distributed along a circumferential direction of a section on the side wall of the coal mining drill bit uniformly; the two types of coal cutting nozzles are alternately arranged at intervals and vertically on the side wall; the coal cutting nozzles are configured to extract coal from the coal seam by spraying the coal cutting slurry.

In some examples of the present disclosure, the nozzles of the coal mining drill bit may include: at least one pair of flushing nozzles.

The at least one pair of flushing nozzles are distributed along a circumferential direction of a section on the side wall of the coal mining drill bit uniformly and are set at an inclined angle on the side wall. The at least one pair of flushing nozzles are configured to form a high-pressure area in the mining site by spraying the coal cutting slurry, and assist the coal cutting nozzles in completing a coal mining work of the coal seam.

In some examples of the present disclosure, the ground facility group may include: a water tank unit, a sand mixing unit, a fracturing pump unit, and a manifold unit. Where, the water tank unit is connected to the sand mixing unit; the fracturing pump unit is connected to the sand mixing unit; and the manifold unit is connected to the fracturing pump unit and the drilling component.

In some examples of the present disclosure, the ground facility group may further include: a gas separation unit, a precipitation unit, and a circulation unit. Where, the gas separation unit is connected to the drilling component and the precipitation unit, to receive the reflux slurry, separate gas in the reflux slurry, and transport remaining slurry to the precipitation unit. The precipitation unit is connected to the circulation unit, to precipitate the remaining slurry and convey a liquid portion of the remaining slurry to the circulation unit. The circulation unit is connected to the water tank unit.

Based on a same concept, the present disclosure also provides a coal and coalbed methane mining method based on ground drilling. The coal and coalbed methane mining method may include: obtaining coal seam information and determining locations of a drilling component and a ground facility group; in response to completing a directional drilling and a setting of a coal mining drill bit according to preset conditions, controlling the ground facility group to provide pressurized coal cutting slurry to the coal mining drill bit through the drilling component and a connecting pipeline; controlling the coal mining drill bit to open nozzles, and controlling the drilling component to drive the connecting pipeline and the coal mining drill bit to retract and spray the coal cutting slurry to mine the coal seam; and controlling the ground facility group to receive reflux slurry carrying coal and coalbed methane from a directional borehole through the drilling component.

In some examples of the present disclosure, after controlling the ground facility group to receive reflux slurry carrying coal and coalbed methane from a directional borehole through the drilling component, the method may further include: monitoring a percentage of coal gangue of the reflux slurry; in response to determining that the percentage of coal gangue is greater than a preset range, controlling the ground facility group to reduce a pressure of the coal cutting slurry; in response to determining the percentage of coal gangue is less than the preset range, controlling the ground facility group to increase the pressure of the coal cutting slurry.

In some examples of the present disclosure, obtaining coal seam information and determining locations of a drilling component and a ground facility group may include: in response to determining a mining range of the coal seam along a direction of the directional borehole is not greater than 400 meters based on the coal seam information, setting up a coal and coalbed methane mining system based on ground drilling; in response to determining that the mining range of the coal seam along the direction of the directional borehole is greater than 400 meters based on the coal seam information, setting up two coal and coalbed methane mining systems based on ground drilling at opposite positions at both ends of the mining range of the coal seam; where, two coal mining drill bits of the two coal and coalbed methane mining systems are set facing each other with a set distance.

Examples of the present disclosure also provides an electronic device, which includes: a memory, a processor, and a computer program stored in the memory and executable on the processor. The processor executes the program to implement the coal and coalbed methane mining method based on ground drilling described above.

Examples of the present disclosure also provide a non-transient computer-readable storage medium which stores computer instructions for causing a computer to execute the coal and coalbed methane mining method based on ground drilling method based on a semantic source described above.

From the above, it can be seen that the present disclosure provides a coal and coalbed methane mining system, a coal and coalbed methane mining method, and related devices based on ground drilling. The coal and coalbed methane mining system include: a drilling component; a coal mining drill bit, set at a predetermined end of a directional borehole in the coal seam, connected to the drilling component through a connecting pipeline; a ground facility group, connected to the drilling component, to provide coal cutting slurry for the coal mining drill bit, receive reflux slurry carrying coal and coalbed methane, and precipitate and separate the reflux slurry carrying the coal and the coalbed methane. Where, the coal mining drill bit has a strip structure, with at least two pairs of nozzles on a side wall; the coal mining drill bit is configured to use the nozzles to spray the coal cutting slurry for mining the coal seam, and spray the coal cutting slurry to form a pressure on a coal mining site so that the reflux slurry can be fed into the directional borehole and delivered to the drilling component and the ground facility group through the directional borehole. By utilizing the coal mining drill bit to product hydraulic coal mining of coal seams, and by utilizing multiple nozzles to form high pressure in the coal mining site, the reflux slurry containing coal and coalbed methane can be hydraulically injected into the directional borehole and transported to the ground through the directional borehole. In this way, safety risks caused by disasters such as gas or water inrush in manual underground mining can be avoided. Further, mining costs can be greatly reduced. Moreover, because the coal mining drill bit only needs to complete a high-pressure water spraying work, the size of the drill bit can be set small, which can meet requirements of a small-sized, large angle or complex coal mining. At the same time, the structure of the coal and coalbed methane mining system is relatively simple, which can reduce risks and mining costs effectively.

BRIEF DESCRIPTION OF THE DRAWINGS

In order to describe technical solutions of the present application or related arts more clearly, accompanying drawings required for describing examples or the related art are introduced briefly in the following. Apparently, the accompanying drawings in the following descriptions only illustrate some examples of the present application, and those of ordinary skill in the art may still derive other drawings from these drawings without creative efforts.

DETAILED DESCRIPTION OF THE EMBODIMENTS

Figure 1:
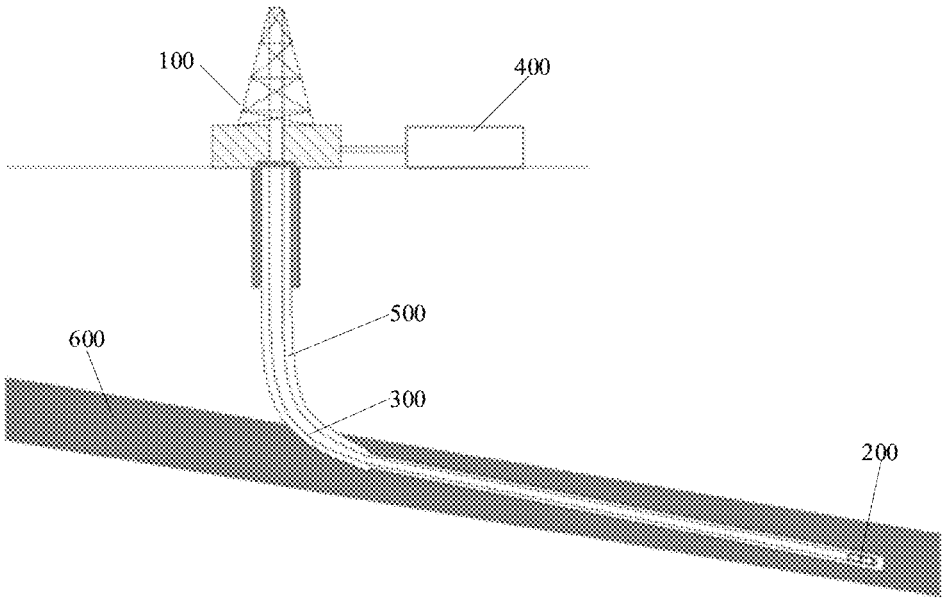
FIG. 1 is a schematic diagram illustrating a structure of a coal and coalbed methane mining system based on ground drilling according to an example of the present disclosure.

Hereinafter, in order to make the objective(s), technical solution(s) and advantages of the present application clearer and more understandable, the present application will be further described in detail, in connection with specific embodiments and with reference to the accompanying drawings.

It is necessary to be noted that the technical terms or scientific terms used in the embodiments of the present application should have common meanings as understood by those skilled in the art of the present application, unless otherwise defined. The "first", "second" and similar words used in the embodiments of the present application do not refer to any sequence, number or importance, but are only used to distinguish different component portions. The "comprise", "include" or a similar word means that an element or item before such word covers an element or item or any equivalent thereof as listed after such word, without excluding other elements or items. The "connect" or "interconnect" or a similar word does not mean being limited to a physical or mechanical connection, but may include a direct or indirect electrical connection. The "upper", "lower", "left" and "right" are used only to indicate a relative position relation, and after the absolute position of the described object is changed, the relative position relation may be changed accordingly.

As stated above, due to limitations of mining technologies, an average recovery rate of early coal mines is 30%~35%, and an average recovery rate of some small coal mines is only 10%~20%. At the same time, under influences of complex geological conditions, a large number of thin coal seams and segmented coal seams are difficult to achieve mechanized or manual mining, resulting in a large amount of residual coal. Due to irregular shapes such as triangles, trapezoids, and leaf shapes in areas where residual coal occurs, as well as the significant variation in coal scam thickness, some residual coal is seriously threatened by gas and water hazards. Therefore, it is difficult to carry out a safe and efficient mining using existing equipment and technology. There is an urgent need for a new mining method that is adaptable, low-cost, safe, green, and efficient.

In related technologies, surface drilling can be used to reach a target coal seam, high-pressure water jet cutting is used for coal mining, and then the coal water magma is separated through the bottom coal rock processing system. Finally, it is transported to the surface through high-pressure transport pipes. This method is not conducive to mining coal scams with large inclination angles, and requires installations and managements of underground facilities, which poses certain risks and increases mining costs.

To solve the above problems, examples of the present disclosure provide a coal and coalbed methane mining system based on ground drilling. The system utilizes a coal mining drill bit for hydraulic coal mining of coal seams, and utilizes multiple nozzles to form a high pressure in a coal mining site. In this way, reflux slurry containing coal and coalbed methane can be hydraulically injected into a directional borehole and transported to a ground through the directional borehole. By the coal and coalbed methane mining system based on ground drilling, safety risks caused by disasters such as gas or water inrush in manual underground mining can be avoided. Mining costs can be greatly reduced. Moreover, because the coal mining drill bit only needs to complete a high-pressure water spraying work, the size of the coal mining drill bit can be set small, which can meet requirements of a small-sized, large angle or complex coal seam mining. At the same time, the structure of the coal and coalbed methane mining system is relatively simple, which can reduce risks and mining costs effectively.

Figure 2:
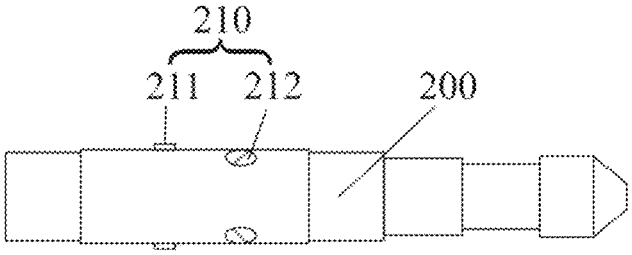
FIG. 2 is a schematic diagram illustrating a structure of a coal mining drill bit according to an example of the present disclosure.
Figure 3:
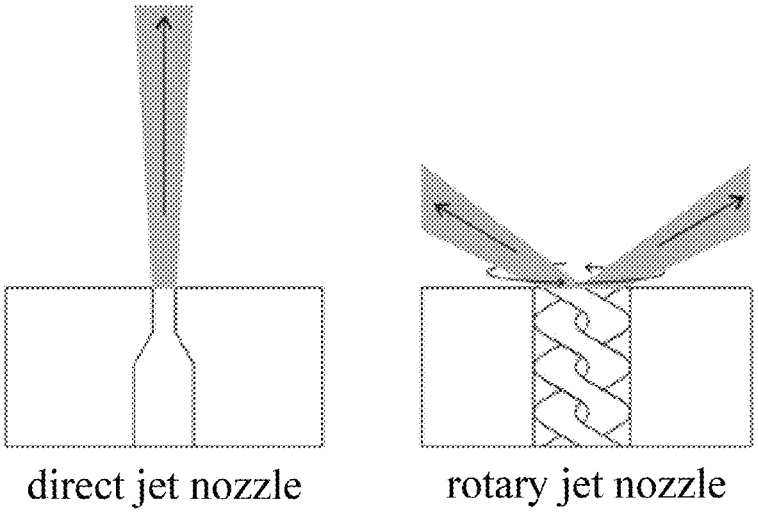
FIG. 3 is a schematic diagram illustrating a structure of a direct jet nozzle and a rotary jet nozzle according to an example of the present disclosure.
Figure 4:
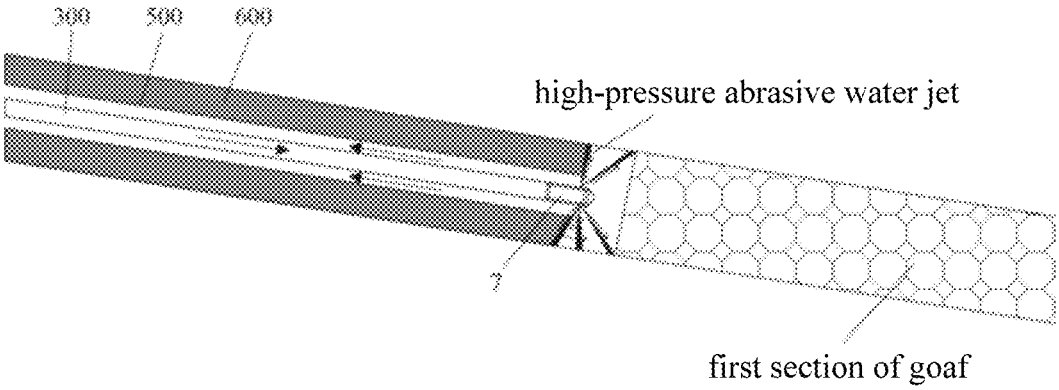
FIG. 4 is a schematic diagram illustrating a slurry flow during the mining process of coal and coalbed methane mining system based on ground drilling according to an example of the present disclosure.

FIG. 1 is a schematic diagram illustrating a structure of the coal and coalbed methane mining system based on ground drilling according to an example of the present disclosure. FIG. 2 is a schematic diagram illustrating a structure of a coal mining drill bit according to an example of the present disclosure. FIG. 3 is a schematic diagram illustrating a structure of a direct jet nozzle and a rotary jet nozzle according to an example of the present disclosure. FIG. 4 is a schematic diagram illustrating a slurry flow during the mining process of coal and coalbed methane mining system based on ground drilling according to an example of the present disclosure.

As shown in FIG. 1 to FIG. 4, the coal and coalbed methane mining system based on ground drilling may include: a drilling component 100; a coal mining drill bit 200, set at a predetermined end of a directional borehole 500 in the coal seam 600, connected to the drilling component 100 through a connecting pipeline 300; a ground facility group 400, connected to the drilling component 100, to provide coal cutting slurry for the coal mining drill bit 200, receive reflux slurry carrying coal and coalbed methane, and precipitate and separate the reflux slurry carrying the coal and the coalbed methane.

Where, the coal mining drill bit 200 has a strip structure, with at least two pairs of nozzles 210 on a side wall; the coal mining drill bit 200 is configured to use the nozzles 210 to spray the coal cutting slurry for mining the coal seam 600, and use the coal cutting slurry sprayed to form a pressure on a coal mining site so that the reflux slurry formed is fed into the directional borehole 500 and delivered to the drilling component 100 and the ground facility group 400 through the directional borehole 500.

According to examples of the present disclosure, the drilling component 100 refers to a main part of a drilling platform for coal mining above the ground. The connecting pipeline 300 is a part of pipelines for slurry transportation, which can transport the coal cutting slurry to the coal mining drill bit 200 for coal mining and filling the goaf. During the coal mining process, the nozzles 210 of the coal mining drill bit 200 can rotate around a central axis of the coal mining drill bit 200 for coal mining. It is also possible to use the drilling component 100 to drive the connecting pipeline 300 to rotate, thereby driving the coal mining drill bit 200 to rotate. At the same time, the drilling component 100 can change the position of the coal mining drill bit 200 by lowering or retrieving the connecting pipeline 300. For example, during the mining process of the coal scam 600, the connecting pipeline 300 can be slowly retrieved. A retrieval speed can be a preset uniform retrieval speed or a variable retrieval speed changed according to specific scenarios. The directional borehole 500 has a hole shaped structure that can accommodate the coal mining drill bit 200 and the connecting pipeline 300. The directional borehole 500 can be drilled at a centerline or a set position of the coal seam 600. Its general size may be larger than the coal mining drill bit 200, so that a gap between the coal mining drill bit 200 and the connecting pipeline 300 can be used to allow the reflux slurry to flow back in, and ultimately be output to the drilling component 100 along the directional borehole 500. As shown in FIG. 1, during a drilling construction, a vertical section can use a Φ 244.5 mm steel pipe for well cementing, an inclined section can use a Φ 177.8 mm steel pipe for well cementing, and a stable inclined section in the coal seam can use a Φ 89 mm fiberglass casing for well cementing. In this way, the directional borehole 500 can be formed. In some examples, the directional borehole 500 located in the coal seam 600 can be assisted and supported by the fiberglass casing, while the fiberglass casing only plays an auxiliary supporting role and can also be cut and destroyed by coal slurry. In some examples, the directional borehole 500 can be set at a centerline position between a top plate and a bottom plate of the coal scam 600, which can improve a mining efficiency of the coal mining drill bit 200.

Figure 5:
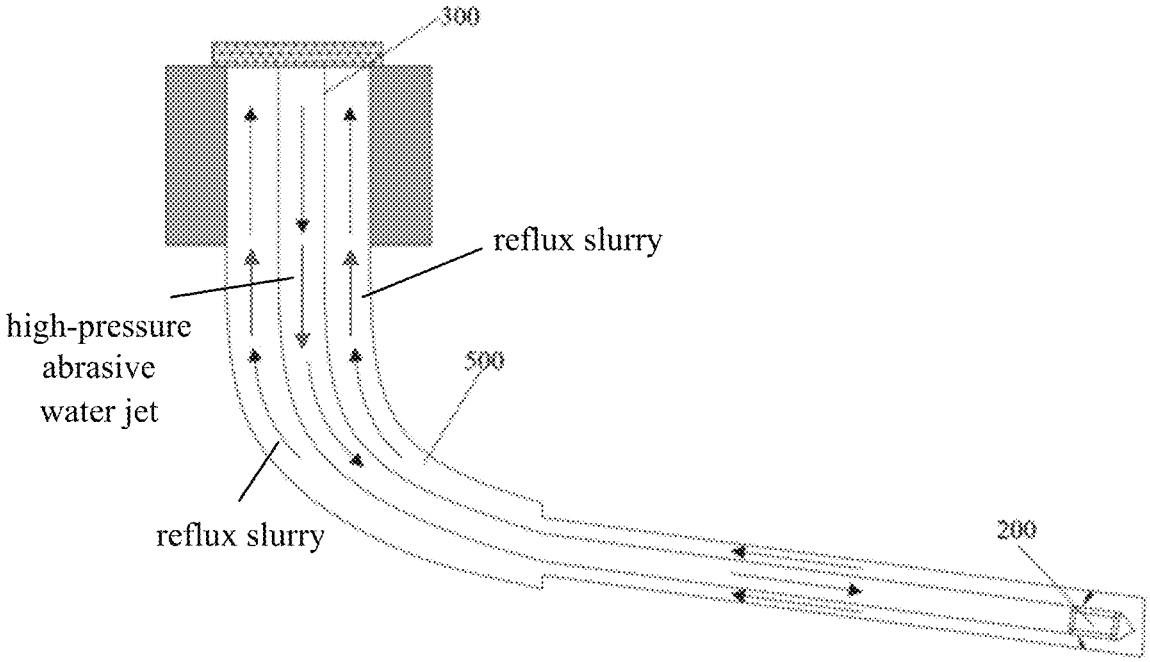
FIG. 5 is a schematic diagram illustrating a slurry flow during the mining process of coal and coalbed methane mining system based on ground drilling according to another example of the present disclosure.

In examples of the present disclosure, a main function of the coal mining drill bit 200 is to complete mining of the coal seam 600 and provide a power for a backflow of the reflux slurry. As shown in FIG. 1 to FIG. 5, during the coal mining process, high-pressure coal cutting slurry will be transported through the connecting pipeline 300. Afterwards, multiple nozzles 210 on the coal mining drill bit 200 can be opened to spray the high-pressure coal cutting slurry, thereby cutting and mining the coal seam 600 with high-pressure water flows. At the same time, the coal cutting slurry sprayed from the nozzles 210 will increase the hydraulic pressure in the coal mining site, allowing the reflux slurry flow back into the directional borehole 500 due to a hydraulic pressure difference. As shown in FIG. 5, a high-pressure abrasive water jet can be used as the coal cutting slurry, and the reflux slurry is coal-water-gas slurry carrying coal and coalbed methane. At this time, the reflux slurry is generally composed of a mixture of three-phase substances such as coal, coalbed methane, and coal cutting slurry (such as water and other liquids). It can be seen, for the coal mining drill bit 200, it only needs to output the coal cutting slurry. Therefore, the size of the coal mining drill bit 200 can be small, making mining in thinner coal seams possible. At the same time, a smaller size can achieve a deep penetration in coal seams more flexibly, making it convenient to enter coal seams with large inclination angles and complex structures. In some examples, to avoid erosion damages caused by high-speed and high-pressure reflux slurry, hard alloy splash proof sleeves can be installed at each nozzle 210 for protection.

In some examples, as shown in FIG. 2 to FIG. 4, in order to facilitate the cutting of the coal seam 600 and facilitate a balance of the coal mining drill bit 200 during coal collections, the nozzles 210 may include at least one pair of coal cutting nozzles 211. And these coal cutting nozzles 211 are uniformly distributed in a circumferential direction on a section of a main body of the coal mining drill bit 200. For example, two coal cutting nozzles 211 can be distributed at an interval of 180 degrees. Four coal cutting nozzles 211 can be distributed at an interval of 90 degrees, and etc. In some examples, as shown in FIG. 3, one half of the coal cutting nozzles 211 can be direct jet nozzles and the other half of the coal cutting nozzles 211 can be rotary jet nozzles. The direct jet nozzle may spray a straight high-pressure abrasive flow perpendicular to the hole wall, achieving hydraulic deep penetration of the coal seam and increasing the single hole mining radius. The rotary jet nozzle can be equipped with an impeller inside, which can achieve a self-rotating injection of a high-pressure abrasive flow at a fixed angle, used to expand the area of coal seam fracture surface and produce a pre-cracking. Thus, the coal mining work for the coal scam 600 can be completed more efficiently in this way. The above two types of coal cutting nozzles 211 can be alternately arranged at intervals and vertically on the side wall, configured to extract coal from the coal seam 600 by spraying the coal cutting slurry. In some specific scenarios, the jet angle of the direct jet nozzle may be perpendicular to the direction of the coal seam 600, while the rotary jet nozzle may spray a self-rotating jet at a fixed angle. The coal cutting nozzle 211 can be equipped with an electric control valve for an opening and closing control.

Afterwards, as shown in FIG. 2 to FIG. 4, in order to facilitate a transportation of the collected coal, assist in the mining of the coal seam, and facilitate the balance of the coal mining drill bit 200 during the coal collection, the nozzles 210 may further include at least one pair of flushing nozzles 212. Similar to the coal cutting nozzles 211, these flushing nozzles 212 can also be uniformly distributed along the circumference on a section of the main body of the coal mining drill bit 200. Of course, due to the fact that these flushing nozzles 212 are mainly used for liquid filling and pressurization of the goaf, providing a larger range of pressure for the reflux slurry containing coal and coalbed methane, their diameters can be larger than that of the coal cutting nozzle 211. However, in general, the flushing nozzle 212 cannot face the coal scam 600 directly, and it needs to have a certain angle with the coal seam 600. Therefore, it can tilt towards the goaf direction at a certain angle. Meanwhile, as shown in FIG. 4, it can also play a certain auxiliary role in the coal mining. For the parts that are not collected by the coal cutting nozzles 211, the flushing nozzles 212 can be used for an auxiliary collection. That is, the at least one pair of flushing nozzles 212 are uniformly distributed along the circumferential direction of a section on the side wall of the coal mining drill bit 200 and are set at an inclined angle on the side wall. They are configured to form a high-pressure area in the mining site by spraying the coal cutting slurry, and assist the coal cutting nozzles 211 in completing the coal mining work of the coal seam 600. In some specific scenarios, an electric control valve can also be installed on the flushing nozzle 212 to control its opening and closing.

Therefore, by using the coal cutting nozzles 211 and the flushing nozzles 212, it is possible to ensure both the jet depth of the coal cutting slurry and the effectiveness of the reflux slurry carrying coal and coalbed methane.

Figure 6:
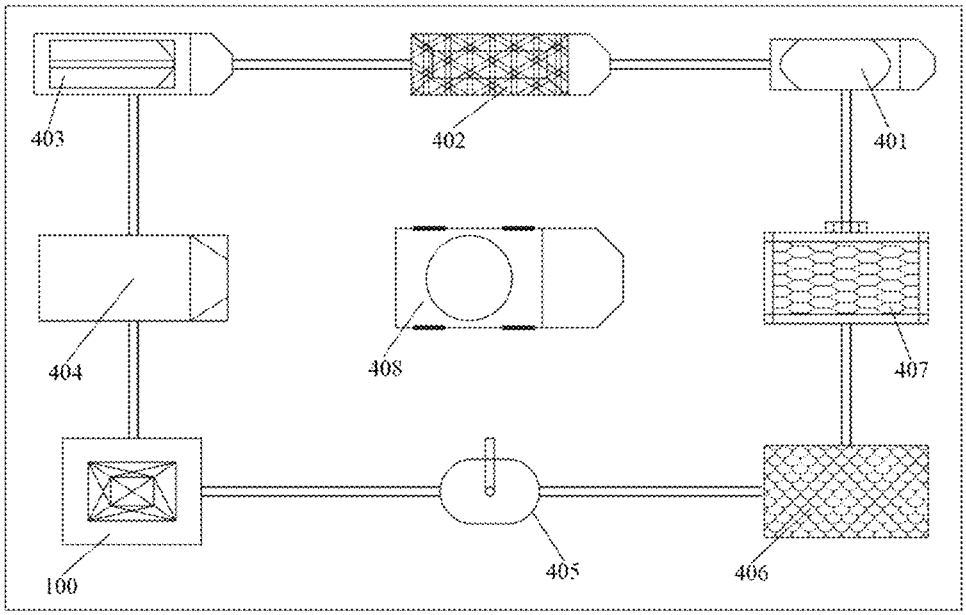
FIG. 6 is a schematic diagram illustrating a structure of the ground facility group according to an example of the present disclosure.

Afterwards, the ground facility group 400 can be used to provide the coal cutting slurry, recover and separate the reflux slurry. As shown in FIG. 6, for the part that provides the coal cutting slurry, the ground facility group 400 may include: a water tank unit 401, a sand mixing unit 402, a fracturing pump unit 403, and a manifold unit 404. Where, the water tank unit 401 can be connected to the sand mixing unit 402; the fracturing pump unit 403 can be connected to the sand mixing unit 402; and the manifold unit 404 can be connected to the fracturing pump unit 403 and the drilling component 100. The water tank unit 401 and the sand mixing unit 402 are configured to provide the coal cutting slurry for coal mining. The fracturing pump unit 403 can be used to provide high pressure for the coal cutting slurry. Moreover, the manifold unit 404 can be used for pipeline collection and other work. As shown in FIG. 6, for the part of recycling and separating the reflux slurry, the ground facility group 400 may further include: a gas separation unit 405, a precipitation unit 406, and a circulation unit 407. Where, the gas separation unit 405 can be connected to the drilling component 100 and the precipitation unit 406, used to receive the reflux slurry, separate the gas components therein, and transport remaining slurry to the precipitation unit 406. The precipitation unit 406 can be connected to the circulation unit 407, used to precipitate the remaining slurry and convey a liquid portion to the circulation unit 407. The circulation unit 407 can be connected to the water tank unit 401, so that the slurry can be recycled to prepare coal cutting slurry. The gas separation unit 405 is mainly used to separate the coalbed methane in the reflux slurry. The precipitation unit 406 is mainly used to separate coal from the reflux slurry. The remaining liquid, as there are no other liquid substances mixed in during the entire process, is still the main component of the coal cutting slurry as a whole, and can be recycled. Of course, in some examples, a control unit 408 for overall control may also be provided. The units included in the aforementioned ground facility group 400 may exist in a form of mobile vehicles or in a form of fixed device structures. In some examples, the ground facility group 400 can be equipped with two sets of fracturing pump units 403, one for use and one for backup. The rated pressure is no less than 105 MPa and the rated displacement is no less than 1200 L/min. At the same time, monitoring devices such as remote control boxes, safety overflow valves, and monitoring probes can also be equipped. The water tank unit 401 can also be equipped with 2 units, which can meet the spraying operation requirements for at least 15 minutes. The sand mixing unit 402 must meet the requirements of at least 1200 L/min and 10-15% sand ratio for sand mixing.

In some examples, the ground facility group 400 can be taken as an example of a movable vehicle. As shown in FIG. 1 to FIG. 6, a specific mining process can include the following steps.

(1) Determining a distribution range of the mining face using a ground penetrating radar detection method combined with drilling data already constructed, based on the analysis of the burial depth, thickness, and lithology of the coal seam to be mined. Determining a wellhead position, an azimuth angle, an inclination point, an inclination angle, an inclination angle of each section of the well, a coal injection point, and a final hole position.

(2) Arranging the water tank unit 401, the sand mixing truck 402, the fracturing pump unit 403, the manifold unit 404, and the control unit 408 near the wellhead of the drilling component 100. Installing the gas separation unit 405 (such as gas separation tank) and the precipitation unit 406 (such as coal slurry precipitation tank) and the circulation unit 407 (such as circulation tank). Installing a connecting pipeline lifting and rotating mechanism at the wellhead of the drilling component 100 (for rotating connecting pipeline 300).

(3) Before drilling, the hole position should be retested. A Φ 311 mm PDC drill bit should be used to drill vertically to the inclined point on the ground, and a Φ 244.5 mm steel pipe should be inserted for first well cementing. The cementing cement should return to the ground to prevent hole collapse. Then, a Φ 215.9 mm PDC drill bit and a Φ 171.5 mm 3° single bending power drilling tool can be used for directional inclination. The inclination may be measured while drilling to the target coal entry point within the range of the coal seam roof. A Φ 177.8 mm steel pipe can be lowered for secondary well cementing. The cementing cement returns to the ground to prevent hole collapse. The stable inclined section of the three openings can be drilled with a Φ 152 mm drill bit, parallel to the direction of the coal seam floor along the design working face, to the final hole position of the coal seam section. A Φ 89 mm fiberglass casing can be inserted to collect comprehensive logging data of the coal bearing strata. Where, the first section is the section that runs vertically downwards from the ground, the second section is the section that bends, and the third section is the section that runs horizontally through the coal seam.

(4) After all the devices are installed, a continuous lifting control mechanism is first controlled to lower the coal seam mining drill bit 200 to a lower limit position of the burial depth range in the coal seam 600. Then, the fracturing pump unit 403, the connecting pipeline lifting and rotating mechanism, and the extraction pump are sequentially started. The water and sand in the sand mixing truck 402 are pressurized by the fracturing pump unit 403 and transported to the coal seam mining drill bit 200 through the connecting pipeline. They are then sprayed through the coal cutting nozzles 211 and the flushing nozzles 212 of the coal seam mining drill bit 200 to form a high-pressure abrasive water jet. At the same time, the connecting pipeline lifting and rotating mechanism drives the connecting pipeline to rotate, causing the high-pressure abrasive water jet to break the coal seam 600 within the circumferential range. Then, the connecting pipeline lifting and rotating mechanism is controlled to make the coal seam mining drill bit 200 rotate while retreating at a set speed until the coal mining drill bit 200 moves the coal seam at a constant. The mining of the section working face has been completed. Complete one mining process.

(5) The collected coalbed methane and coal powder cut by the jet are fully mixed with water under the impact of high-pressure water to form turbulence (i.e. reflux slurry), which flows into the annulus between the coal mining drill bit 200 and the directional borehole 500 (or the fiberglass casing embedded in the directional borehole 500). Due to the high-pressure state of the water formed by the underground jet, the annulus is connected to the ground. Under the impact of pressure difference and turbulence, the reflux slurry returns to the drilling component 100 and is transported to the gas separation unit 405 through a pipeline installed along the horizontal direction of the drilling component 100 for conveying the reflux slurry. The gas separation unit 405 transports the coalbed methane to a coalbed methane storage device through an upper outlet by gravity settling, and the coal water slurry is transported to the precipitation unit 406 through a lower outlet. The bottom of the precipitation unit 406 is coal slag, and the upper part is filtered wastewater. After the precipitation unit 406 is filled, the wastewater overflows to the circulation unit 407. Under the action of a pump, the water in the circulation unit 407 may be transported through the pipeline to the input water port of the water tank unit 401, which can be reused to prepare high-pressure abrasive slurry and achieve underground coal cutting operations.

From the above, it can be seen that the present disclosure provides a coal and coalbed methane mining system based on ground drilling, including: a drilling component; a coal mining drill bit, set at an end position of a predetermined directional borehole in the coal scam, connected to the drilling component through a connecting pipeline; a ground facility group, connected to the drilling component, to provide coal cutting slurry for the coal mining drill bit, receive reflux slurry carrying coal and coalbed methane, and precipitate and separate the reflux slurry carrying the coal and the coalbed methane. Where, the coal mining drill bit has a strip structure, with at least two pairs of nozzles on a side wall; the coal mining drill bit is configured to use the nozzles to spray the coal cutting slurry for mining the coal seam, and use the coal cutting slurry sprayed to form a pressure on a coal mining site so that the reflux slurry formed is fed into the directional borehole and delivered to the drilling component and the ground facility group through the directional borehole.

By utilizing coal mining drill bits for hydraulic coal mining of coal scams, and by utilizing multiple nozzles to form the high pressure in the coal mining site, the reflux slurry containing coal and coalbed methane can be hydraulically injected into the directional borehole and transported to the ground through the directional borehole. In this way, safety risks caused by disasters such as gas or water inrush in manual underground mining can be avoided. Mining costs can be greatly reduced. Moreover, because the coal mining drill bits only need to complete a high-pressure water spraying work, the volume of these drill bits can be set small, which can meet the requirements of a small-sized, large angle or complex coal seam mining. At the same time, the structure of the coal and coalbed methane mining system is relatively simple, which can reduce risks and mining costs effectively.

Figure 8:
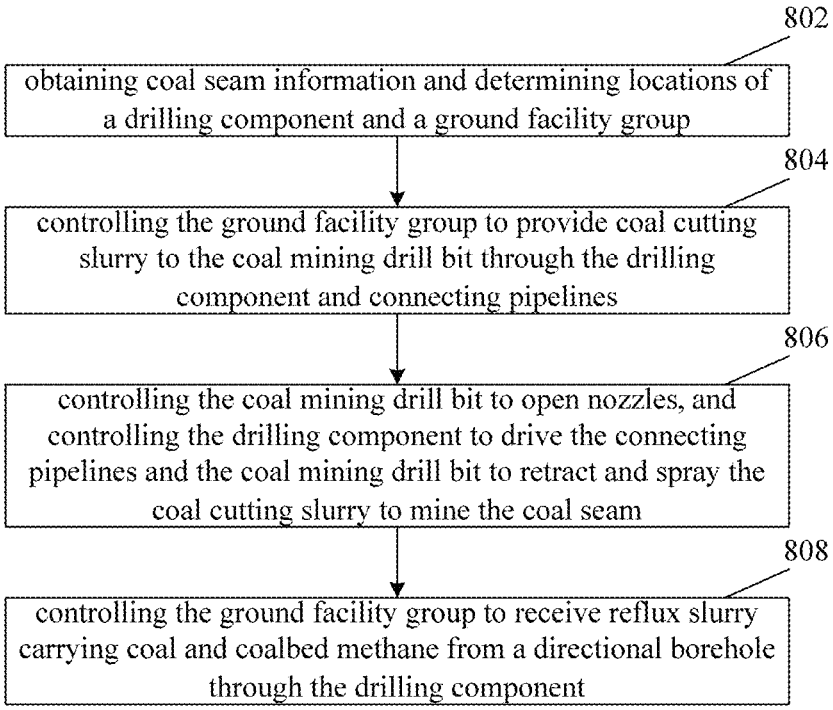
FIG. 8 is a schematic flowchart of a coal and coalbed methane mining method based on ground drilling according to an example of the present disclosure.

Based on a same concept, examples of the present disclosure also provide a coal and coalbed methane mining method based on ground drilling applied in the coal and coalbed methane mining system based on surface drilling as described in any of the examples. As shown in FIG. 8, the method may specifically include the following steps.

In step 802, obtaining coal seam information and determining locations of a drilling component and a ground facility group.

In step 804, in response to completing a directional drilling and setting of a coal mining drill bit according to preset conditions, controlling the ground facility group to provide coal cutting slurry to the coal mining drill bit through the drilling component and connecting pipelines.

In step 806, controlling the coal mining drill bit to open nozzles, and controlling the drilling component to drive the connecting pipelines and the coal mining drill bit to retract and spray the coal cutting slurry to mine the coal scam.

In step 808, controlling the ground facility group to receive reflux slurry carrying coal and coalbed methane from a directional borehole through the drilling component.

The coal seam information may refer to a position, a direction, a shape and other relevant parameters of a coal seam (such as wellhead position, azimuth, deflecting point, deflecting rate, deflecting angle of each section, and etc.). The coal seam information may be determined according to previous surveying and mapping, as well as a coal entry point and a final hole position calculated based on these data.

Figure 7:
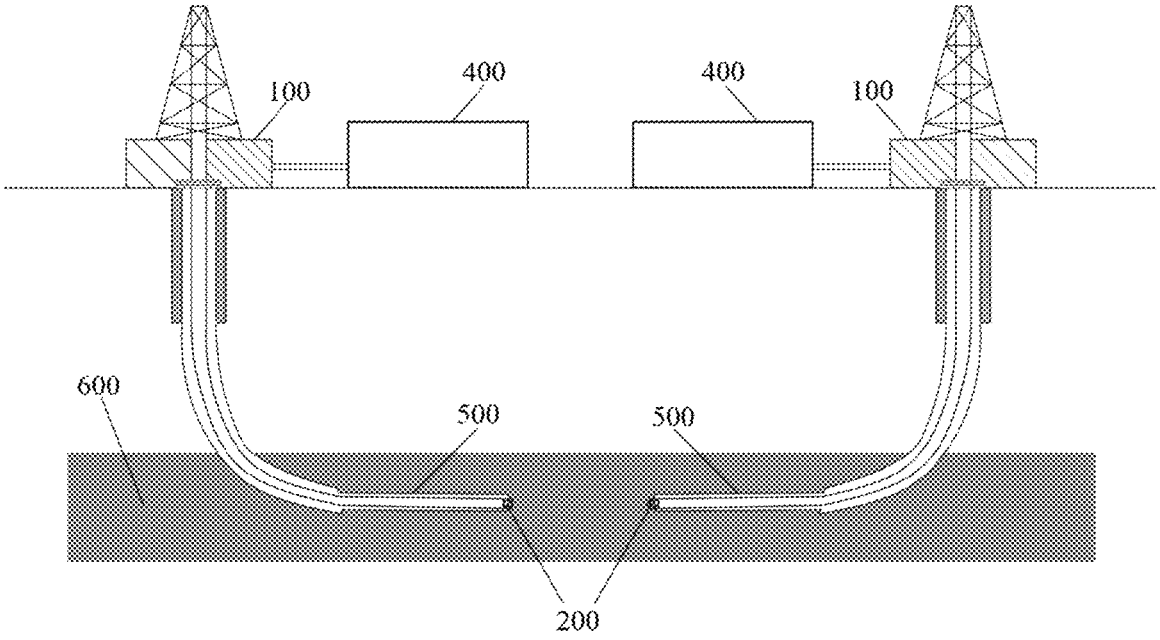
FIG. 7 is a schematic diagram illustrating a setting of multiple coal and coalbed methane mining systems based on ground drilling according to an example of the present disclosure.

In some examples of the present disclosure, in order to avoid difficulties such as high construction costs and difficult control of drilling trajectories in ultra long directional drilling. As shown in FIG. 1 and FIG. 7, the layout of a project depends on the length of the working face. When the length of the working face is less than 400 meters, a single well mining can be used to form an L-shaped borehole. When the length of the working face is greater than 400 meters, a double well mining with two wellheads on the same straight line is used to form a U-shaped borehole. When using double well mining, coal pillars are reserved between the final drilling positions (i.e. the position where the final coal seam mining drill bit is set) based on the simulated or measured range of stress damage caused by drilling ahead of the roof bedrock properties to ensure gas tightness during extraction. That is, in some examples of the present disclosure, obtaining coal seam information and determining locations of a drilling component and a ground facility group may include: in response to determining a mining range of the coal seam along a direction of the directional drilling is not greater than 400 meters based on the coal seam information, setting up a coal and coalbed methane mining system based on ground drilling; in response to determining that the mining range of the coal seam along the direction of the directional drilling is greater than 400 meters based on the coal seam information, setting up two coal and coalbed methane mining systems based on ground drilling at opposite positions at both ends of the mining range of the coal seam; where, two coal mining drill bits of the two coal and coalbed methane mining systems are set facing each other with a set distance. At the same time, a long-distance directional gas extraction and a surface coal water gas separation can be achieved through an L-shaped or a U-shaped drilling on the ground, and the water used for extraction can be recycled and reused.

At the same time, long-distance directional gas extraction and surface coal water gas separation can be achieved through L-shaped or U-shaped drilling on the ground, and the water used for extraction can be recycled and reused. That is, in some examples of the present disclosure, after controlling the ground facility group to receive the reflux slurry carrying coal and coalbed methane from a directional borehole through the drilling component the method may further include: monitoring a percentage of coal gangue of the reflux slurry; in response to determining that the percentage of coal gangue is greater than a preset range, controlling the ground facility group to reduce a pressure of the coal cutting slurry; in response to determining the percentage of coal gangue is less than the preset range, controlling the ground facility group to increase the pressure of the coal cutting slurry.

The method of the above example can be applied to the corresponding coal and coalbed methane mining system based on ground drilling in the above examples. The specific content and corresponding beneficial effects of the above steps have already been described in the above coal and coalbed methane mining system based on ground drilling, and will not be repeated here.

It should be noted that the method of the present disclosure can be executed by a single device, such as a computer or server. The method of the present disclosure can also be applied in distributed scenarios, where multiple devices cooperate with each other to complete a task. In this distributed scenario, one device among these multiple devices can only perform one or more steps of the method described in any of the examples of the present disclosure, and these multiple devices will interact with each other to complete the method.

It should be noted that specific examples of the present disclosure have been described above. Other examples are within the scope of the appended claims. In some cases, the actions or steps described may be performed in a different order than in the examples described above and still achieve the desired results. In addition, the process depicted in the drawing does not necessarily require a specific or continuous order to achieve the desired results. In some implementations, multitasking and parallel processing are also possible or may be advantageous.

Examples of the present disclosure also provides an electronic device, which includes a memory, a processor, and a computer program stored in the memory and executable on the processor, the processor executes the program to implement the coal and coalbed methane mining method based on a semantic source.

Figure 9:
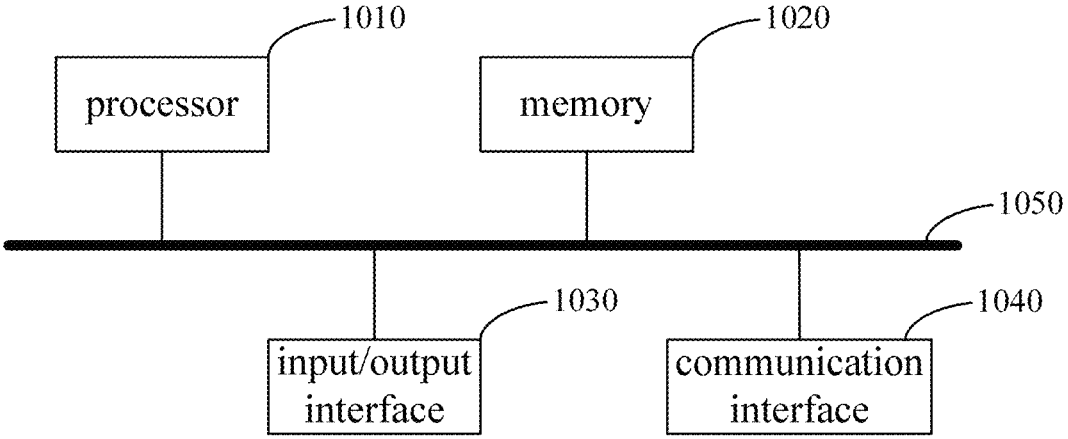
FIG. 9 is a structural block diagram of an electronic device according to an example of the present disclosure.

FIG. 9 is a schematic diagram illustrating a structure of an electronic device according to some examples of the present disclosure. As shown in FIG. 7, the electronic device may include: a processor 1010, a memory 1020, an input/output interface 1030, a communication interface 1040, and a bus 1050. The processor 1010, the memory 1020, the input/output interface 1030, and the communication interface 1040 may couple to each other via the bus 1050.

The processor 1010 may execute the relevant procedures by virtue of a general central processing unit (CPU), a microprocessor, an application specific integrated circuit (ASIC), or one or more integrated circuits, so as to implement the technical solution provided by the examples of the description.

The memory 1020 may be implemented by a read only memory (ROM), a random-access memory (RAM), a static memory device and a dynamic memory device, etc. The memory 1020 may store an operating system and other application procedures. When the technical solution provided by the example of the description is implemented via the software or the hardware, the related procedure codes are stored in the memory 1020 and revoked by the processor 1010.

The I/O interface 1030 is used for connecting an I/O unit to realize information input and output. The I/O unit may be configured in the device (not in the figure) as a component configuration, and may be externally connected to the device to provide the corresponding functions. The input device may include keyboard, mouse, touch screen, microphone and various sensors. The output device may include display, loudspeaker, vibrator and indicator lamp.

A communication interface 1040 is used for connecting a communication unit (not shown in the figure) to realize communication interaction between the device and other devices. The communication unit may realize communication in a wired manner (for example, USB, wire, etc.) or in a wireless manner (for example, mobile network, WIFI, Bluetooth, etc.).

The bus 1050 includes a passage which transmits information among various components (for example, the processor 1010, the memory 1020, the I/O interface 1030 and the communication interface 1040) on the device.

It should be noted that, although the above-mentioned device merely shows the processor 1010, the memory 1020, the I/O interface 1030, the communication interface 1040 and the bus 1050, the device may further include other components required by the normal operation in the specific implementation process. Besides, those skilled in the art could appreciate that the above-mentioned device may merely include the components required by the solution in the examples of the Description, but not necessarily include all components shown in the figure.

The above-mentioned device of the present disclosure is used to realize the coal and coalbed methane mining method based on a semantic source in accordance with any of the above examples, and has the beneficial effects of the corresponding method, which will not be repeated here.

Based on a same inventive concept, examples of the present disclosure also provide a non-transitory computer-readable storage medium, which stores a computer instruction. The computer instruction is used to make a computer execute the coal and coalbed methane mining method based on a semantic source in accordance with any of the above examples.

The computer-readable storage medium in the example includes volatile, non-volatile, movable and non-movable media, which can realize information storage by any method or technology. The information can be computer readable instruction, data structure, program unit or other data. The example of computer storage media includes, but not limited to phase-change memory (PRAM), static random access memory (SRAM), dynamic random access memory (DRAM), other types of random access memory (RAM), read only memory (ROM), electrically erasable programmable read-only memory (EEPROM), flash memory or other memory technologies, compact disk read only memory (CD-ROM), digital versatile disc (DVD) or other optical memories, cassette magnetic tape, tape, disk memory or other magnetic memory device or any other non-transmission media, and available for storing information accessible by the computing devices.

Based on a same inventive concept of the coal and coalbed methane mining method based on a semantic source described in any of the above examples, the present disclosure also provides a computer program, which includes computer instructions. In some examples, the computer instructions may be executed by one or more processors of a computer to enable the computer and/or processor to execute the coal and coalbed methane mining method based on a semantic source. Corresponding to the execution subject of each step in examples of the coal and coalbed methane mining method based on a semantic source, the processor executing the corresponding step can belong to the corresponding execution subject.

The computer program of the above example is used to enable the computer and/or processor to execute a coal and coalbed methane mining method based on a semantic source as described in any one of the above examples, and has the beneficial effects of corresponding methods, which will not be repeated here.

Those of ordinary skill in the art should appreciate that the discussion on any one of the foregoing examples is merely exemplary, but is not intended to imply that the scope of the present disclosure (including the claims) is limited to these examples. Under the idea of the present disclosure, the technical features of the foregoing examples or different examples may be combined, the steps may be implemented in any order, and there are many other variations in different aspects of the examples of the present disclosure, all of which are not provided in detail for simplicity.

Besides, for the sake of simplifying description and discussion and not making the examples of the present disclosure difficult to understand, the provided drawings may show or not show the public power supply/earthing connection to an integrated circuit (IC) chip and other parts. Besides, the device may be shown in block diagram form to prevent the examples of the present disclosure from being difficult, and moreover, this considers the following facts, that is, the details of the implementations with regard to the devices in these block diagrams highly depend on the platform which will implement the examples of the present disclosure (that is, these details should be completely within the scope understood by those skilled in the art). Where specific details (e.g. circuits) are set forth in order to describe exemplary examples of the present disclosure, it should be apparent to those skilled in the art that the examples of the present disclosure can be practiced without, or with variation of, these specific details. Therefore, these descriptions shall be considered to be illustrative instead of restrictive thereto. Therefore, these descriptions shall be considered to be illustrative instead of restrictive thereto.

While the present disclosure has been described in conjunction with specific examples thereof, many alternatives, modifications and variations of such examples will be apparent to those of ordinary skill in the art in light of the foregoing description. For example, other memory architectures, such as dynamic RAM (DRAM), may use the examples discussed.

The examples of the disclosure are intended to embrace all such alternatives, modifications, and variations as to fall within the broad scope of the appended claims. Therefore, any omission, modification, equivalent replacement and improvement made within the spirits and principles of the examples of the present disclosure shall fall within the protection scope of the present disclosure.

What is claimed is:

1. A coal and coalbed methane mining system based on ground drilling, comprising:

a drilling component;

a coal mining drill bit, set at a predetermined end of a directional borehole in a coal seam, connected to the drilling component through a connecting pipeline;

a ground facility group, connected to the drilling component, to provide coal cutting slurry for the coal mining drill bit, receive reflux slurry carrying coal and coalbed methane, and precipitate and separate the reflux slurry carrying the coal and the coalbed methane; wherein, the coal mining drill bit is with a strip-shaped structure, with at least two pairs of nozzles installed on a side wall; the coal mining drill bit is configured to use the nozzles to spray the coal cutting slurry for mining the coal seam, and spray the coal cutting slurry to form a pressure on a coal mining site so that the reflux slurry formed is fed into the directional borehole and delivered to the drilling component and the ground facility group through the directional borehole;

the nozzles of the coal mining drill bit comprise: at least one pair of coal cutting nozzles, wherein, one half of the coal cutting nozzles are direct jet nozzles and the other half of the coal cutting nozzles are rotary jet nozzles; wherein, the direct jet nozzles are used for a hydraulic deep penetration of the coal seam, and the rotary jet nozzles are used to expand a fracture surface area of the coal seam and produce an advance pre-splitting; and the at least one pair of coal cutting nozzles are distributed along a circumferential direction of a section on the side wall of the coal mining drill bit uniformly; the two types of the coal cutting nozzles are alternately arranged at intervals and vertically on the side wall; and the coal cutting nozzles are configured to extract coal from the coal seam by spraying the coal cutting slurry.

2. The system according to claim 1, wherein, the nozzles of the coal mining drill bit comprise: at least one pair of flushing nozzles; and the at least one pair of flushing nozzles are distributed along a circumferential direction of a section on the side wall of the coal mining drill bit uniformly and are set at an inclined angle on the side wall; the at least one pair of flushing nozzles are configured to form a high-pressure area in the coal mining site by spraying the coal cutting slurry, and assist the coal cutting nozzles in completing a coal mining work of the coal seam.

3. The system according to claim 1, wherein, the ground facility group comprises: a water tank unit, a sand mixing unit, a fracturing pump unit and a manifold unit; wherein, the water tank unit is connected to the sand mixing unit; the fracturing pump unit is connected to the sand mixing unit; and the manifold unit is connected to the fracturing pump unit and the drilling component.

4. The system according to claim 3, wherein, the ground facility group further comprises: a gas separation unit, a precipitation unit, and a circulation unit; wherein, the gas separation unit is connected to the drilling component and the precipitation unit, to receive the reflux slurry, separate gas in the reflux slurry, and transport remaining slurry to the precipitation unit; the precipitation unit is connected to the circulation unit, to precipitate the remaining slurry and convey a liquid portion of the remaining slurry to the circulation unit; and the circulation unit is connected to the water tank unit.

5. A coal and coalbed methane mining method based on ground drilling applied in the coal and coalbed methane mining system based on ground drilling according to claim 1, comprising:

obtaining coal seam information and determining locations of the drilling component and the ground facility group;

in response to completing a directional drilling and a setting of the coal mining drill bit according to preset conditions, controlling the ground facility group to provide pressurized coal cutting slurry to the coal mining drill bit through the drilling component and the connecting pipeline;

controlling the coal mining drill bit to open nozzles, and controlling the drilling component to drive the connecting pipeline and the coal mining drill bit to retract and spray the coal cutting slurry to mine the coal seam; and controlling the ground facility group to receive reflux slurry carrying coal and coalbed methane from a directional borehole through the drilling component.

6. The method according to claim 5, wherein, after controlling the ground facility group to receive reflux slurry carrying coal and coalbed methane from a directional borehole through the drilling component, the method further comprises:

monitoring a percentage of coal gangue of the reflux slurry;

in response to determining that the percentage of coal gangue is greater than a preset range, controlling the ground facility group to reduce a pressure of the coal cutting slurry; and in response to determining the percentage of coal gangue is less than the preset range, controlling the ground facility group to increase the pressure of the coal cutting slurry.

7. The method according to claim 5, wherein, obtaining coal seam information and determining locations of a drilling component and a ground facility group comprises:

in response to determining a mining range of the coal seam along a direction of the directional borehole is not greater than 400 meters based on the coal seam information, setting up a coal and coalbed methane mining system based on ground drilling; and in response to determining that the mining range of the coal seam along the direction of the directional borehole is greater than 400 meters based on the coal seam information, setting up two coal and coalbed methane mining systems based on ground drilling at opposite positions at both ends of the mining range of the coal seam; where, two coal mining drill bits of the two coal and coalbed methane mining systems are set facing each other with a set distance.

* * * * *